United States Patent [19]

Röder

[11] Patent Number: 5,002,082

[45] Date of Patent: Mar. 26, 1991

[54] SELF-ERECTING TENT

[75] Inventor: Heinz Röder, Büdingen, Fed. Rep. of Germany

[73] Assignee: Röder GmbH, Büdingen, Fed. Rep. of Germany

[21] Appl. No.: 275,086

[22] PCT Filed: Mar. 11, 1987

[86] PCT No.: PCT/EP87/00139

§ 371 Date: Sep. 14, 1988

§ 102(e) Date: Sep. 14, 1988

[87] PCT Pub. No.: WO87/05653

PCT Pub. Date: Sep. 24, 1987

[30] Foreign Application Priority Data

Mar. 14, 1986 [EP] European Pat. Off. ..... 86103470.0

[51] Int. Cl.[5] ..... E04H 15/06

[52] U.S. Cl. ..... 135/88; 135/99; 135/26; 135/108

[58] Field of Search ..... 52/110, 111, 121, 143; 135/88, 98, 99, 905, 108, 114, 26

[56] References Cited

U.S. PATENT DOCUMENTS

| | | | |
|---|---|---|---|
| 246,118 | 8/1881 | Garver | 135/108 |
| 487,544 | 12/1892 | Simon | 135/108 |
| 540,098 | 5/1895 | Grove | 135/26 |
| 1,098,027 | 5/1914 | Ekland | 135/26 |
| 2,148,949 | 2/1939 | Mahaffey | 135/114 |
| 2,165,967 | 7/1939 | Haupt | 135/26 |
| 2,599,513 | 6/1952 | Griffin | 135/26 |
| 2,601,865 | 7/1952 | Campbell | 135/99 |
| 2,811,164 | 10/1957 | Ames | 135/99 |
| 4,062,156 | 12/1977 | Roth | 52/111 |
| 4,068,673 | 1/1978 | Bernardi | 135/90 |
| 4,111,217 | 9/1978 | Victor | 135/114 |
| 4,238,911 | 12/1980 | Mazur | 52/111 |

FOREIGN PATENT DOCUMENTS

| | | | |
|---|---|---|---|
| 52258 | 5/1982 | European Pat. Off. | 135/26 |
| 625783 | 1/1936 | Fed. Rep. of Germany | 135/26 |
| 2217978 | 9/1974 | France . | |
| 2330829 | 3/1977 | France . | |
| 2557909 | 7/1985 | France . | |
| 6817777 | 6/1970 | Netherlands . | |
| 13892 | of 1914 | United Kingdom | 135/26 |
| 532375 | 1/1941 | United Kingdom | 135/26 |
| 677448 | 8/1952 | United Kingdom | 135/26 |
| 1313155 | 4/1973 | United Kingdom . | |
| 2197672 | 5/1988 | United Kingdom | 135/99 |

*Primary Examiner*—Henry E. Raduazo

*Attorney, Agent, or Firm*—Marmorek, Guttman & Rubenstein

[57] ABSTRACT

A self-erecting tent can be erected in various sizes and shapes and is characterized by the fact that the tent can be changed. It can be mounted on a transportable or rolling and supportable platform, which can be converted from a transport position into an erection position. The tent consists of a telescopic support mast and a plurality of telescopic arms, the folded roof fabric being connected to the endmost extended element of each arm in order to provide tension and support when it is extended and foldability when it is retracted.

9 Claims, 5 Drawing Sheets

SELF-ERECTING TENT

The instant invention relates to a self-erecting tent which can be brought on a traveling or rolling and supportable platform from a transportation position into an erection position and which consists of a telescoping mast as well as of a plurality of locking bars whereby the folded roof skin in the area of the locking bars is connected to the ends of the locking bars furthest from the mast to stretch it in deployment and at least to support it during telescoping.

Such a tent is also known through FR-A-2330829.

It basically provides for the traveling and supportable platform to be admissible under the road traffic regulations of the different countries, or under special authorizations for authorized flatbeds which, in some cases, could also be in form of semitrailers.

Other self-erecting tents with a travelling or rolling and supportable platform which can be erected by one single person or a small number of persons are not known.

Beyond this, aluminum scaffold tents of various designs are known, but their erection generally not only requires a number of persons, but requires also relatively highly skilled erection site personnel.

Otherwise, small tents are known in the military; they are divided into individual carrying loads and canbe erected by one or several persons, and this applies of course also to camping enthusiasts.

For this reason it is the object of the instant invention to propose a self-erecting tent of the type described initially, the smaller models of which can be erected by one person alone and which would require a minimum of personnel for the erection in case of a larger size tent of this type if needed.

The object of the invention provides for a plurality of telescoping and/or unfolding locking bars to be attached to the mast via base elements of the mast in predetermined directions and at predetermined angles and for sub-elements of each base element to be telescoped into same in transportation position, whereby the last sub-element, in the deployed or unfolded state of the locking bars, determines the tension of the roof skin and whereby each final sub-element of the locking bar is connected to the latter by means of a stem oriented in direction of the road surface.

In transportation position the sub-elements are telescoped into the base elements attached in predetermined directions and at predetermined angles to the mast, or if unfolding locking bars are used, the sub-elements are attached to same. The telescoping or folding and unfolding end elements of the individual locking bars constitute, together with the roof skin which is folded in transportation position, a unit that can be called a cap.

In the deployed or unfolded state of the locking bars they determine the tension of the roof skin.

The stability of the entire tent is increased significantly by the support provided to each sub-element at the end of the locking bars by a strut connected to it and oriented in direction of the road surface, since the forces to be absorbed need then not be absorbed exclusively by the traveling or rolling and supportable platform.

It should be noted that the object of the invention is thus achieved.

It should further be noted that the struts should be fashioned so as to bear end awnings. This makes it possible to close the tent without drafts near the floor.

As a further development it should be noted that the telescoping segments of the mast and of the locking bars can be secured against twisting by giving said telescoping segments prismatic cross-sections of a desired type.

This design of the telescoping parts which secures them against twisting provides a simple solution to this problem, since no weakening of the cross-section takes place as is the case with cylindrical telescoping parts because of the necessity of providing a wedge which runs in a groove.

Concerning the configuration of the tent it should be noted that the configuration of the basic outline is determined by the number of locking bars attached to the mast and by their length, and that when locking bars of unequal length and essentially oriented in one direction are used, the center of the locking bar connection is located outside the center of gravity but within the platform.

Of course, this requirement only applies if the locking bars supported by the struts are unable to support a further shifting of the center of gravity.

Although the telescoping locking bars should in general be preferred to the unfolding ones, provisions can be made when unfolding locking bars are used, for individual locking bars, consisting of unfolding elements, to be articulatedly connected to their base element which is installed on the mast and to be capable of locking at different settings.

Great versatility as far as combination with other structures or other self-erecting tents is thus achieved.

The locking bars of a second tent of this type can be made for example so that they can be combined into a double tent with the above-mentioned tent at the ends of its locking bars, the locking bars to be combined being set essentially in a horizontal position.

In conclusion and to summarize, it should again be noted that the folding of the tent roof is assisted through the telescoping of the locking bars, whereby a further combination of the roof skin and of the end zones of the other locking bar elements of each locking bar ensures its sufficient and precise folding during telescoping.

It should also be noted that the telescoped telescoping mast, including the telescoped or folded locking bar segments constitute a practically closed transportation unit together with the roof skin in transportation position, with dimensions that can be kept within the general limits generally imposed by road traffic regulations.

Merely the struts and the awnings are to be added to the platform as an additional package or can be transported separately. The object of the invention is explained in greater detail through FIGS. 1 to 4 of the attached drawings of an embodiment given as an example. FIGS. 5 to 10 shown examples of outlines as seen from above.

Figure 1:
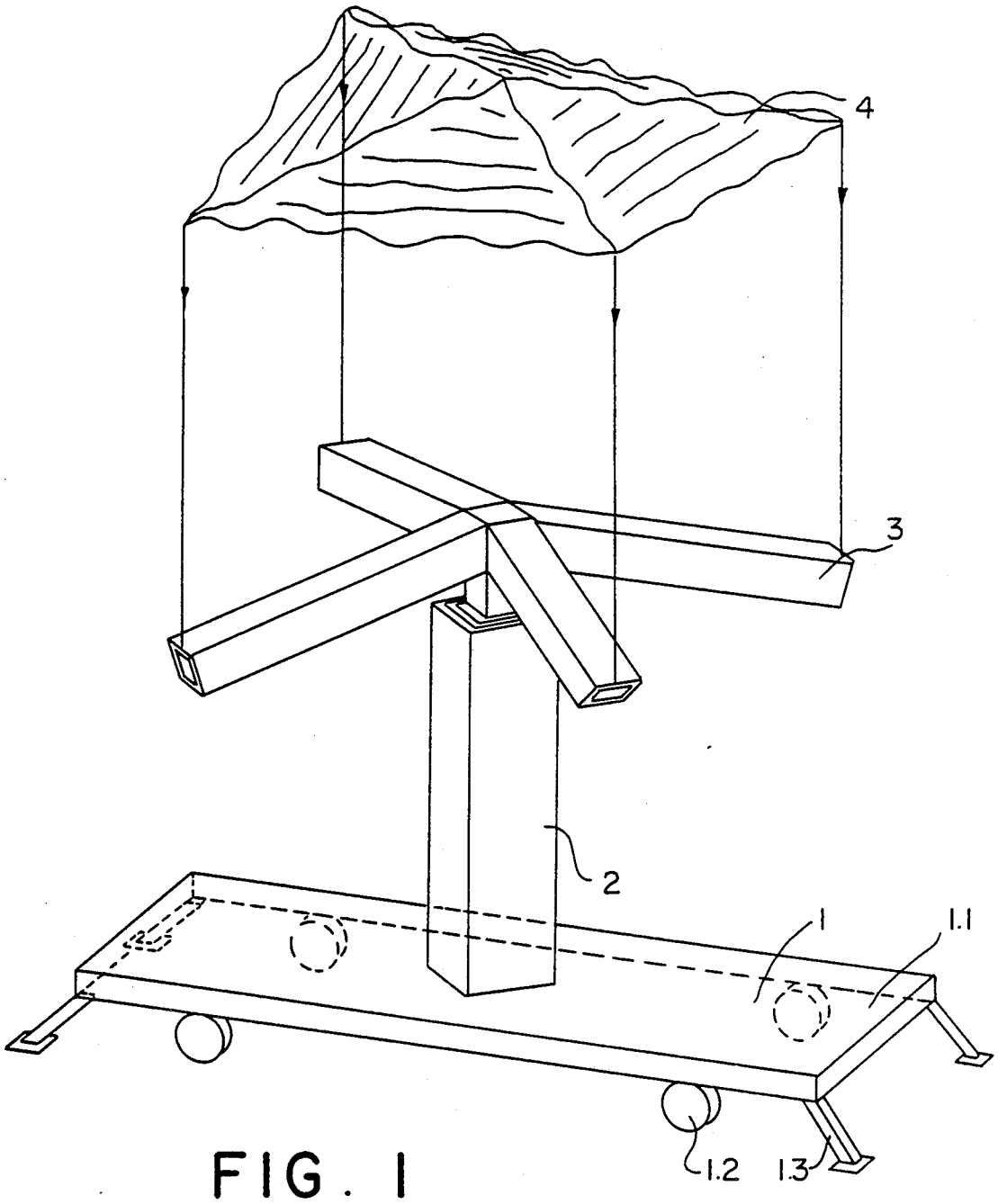
FIG. 1 shows the self-erecting tent in telescoped transportation position, but with supports already deployed and, as indicated above these by reference lines, the roof skin of the tent, connected to the telescoping locking bars.
Figure 2:
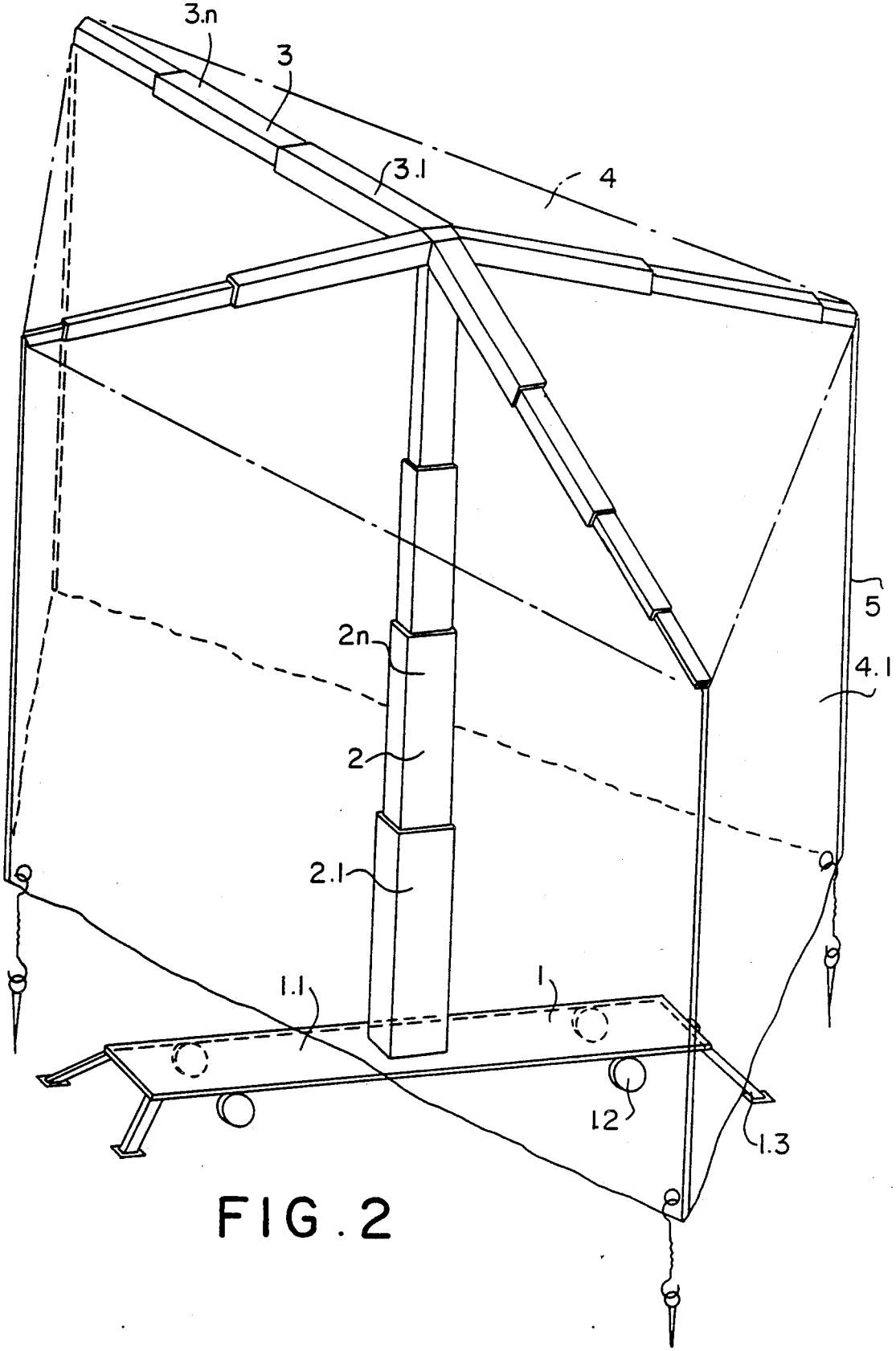
FIG. 2 shows a self-erecting tent with the telescoping support mast and partially deployed locking bars, whereby the roof skin which is connected to the upper locking bar surfaces is also deployed as indicated by the broken outline.
Figure 3:
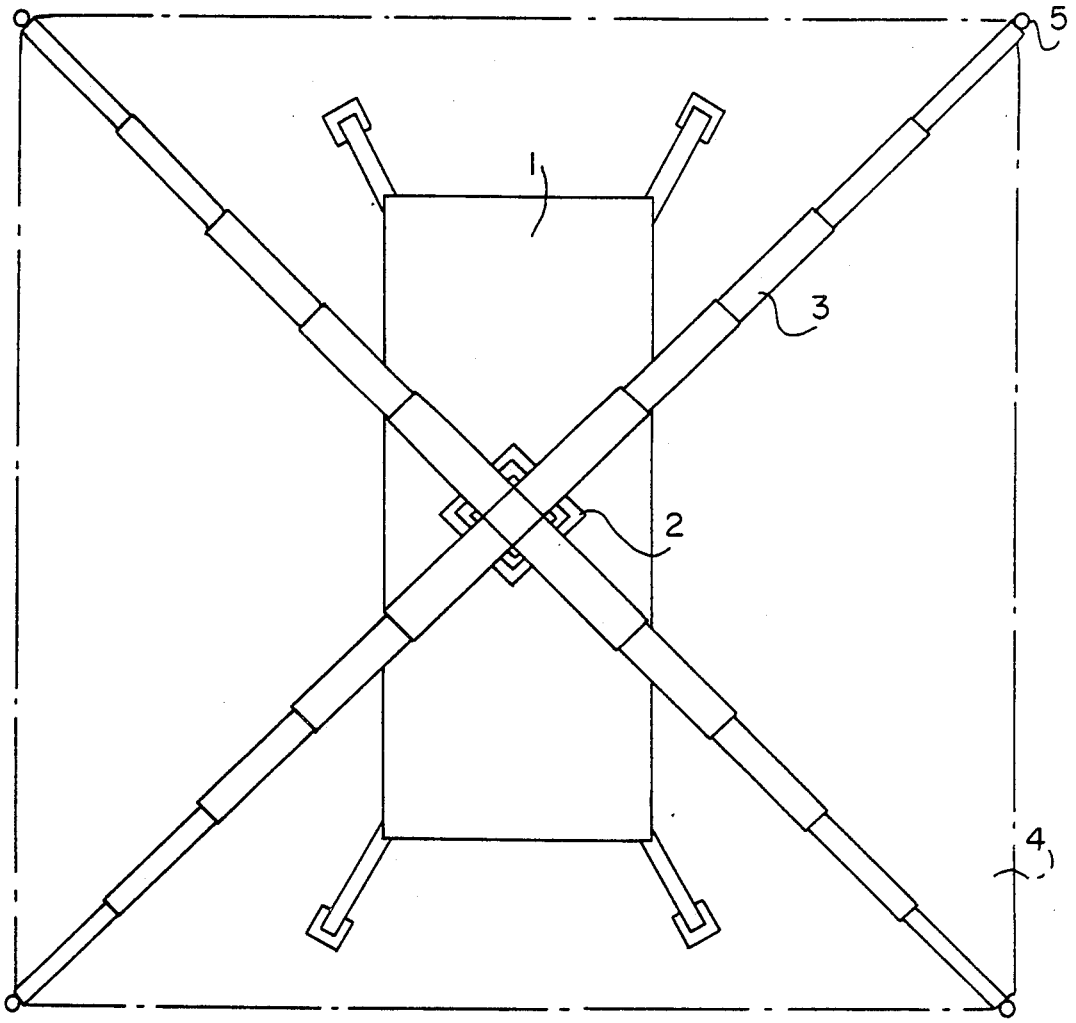
FIG. 3 shows the completely erected tent of FIGS. 1 and 2, with a square outline of the roof skin in top view.
Figure 4:
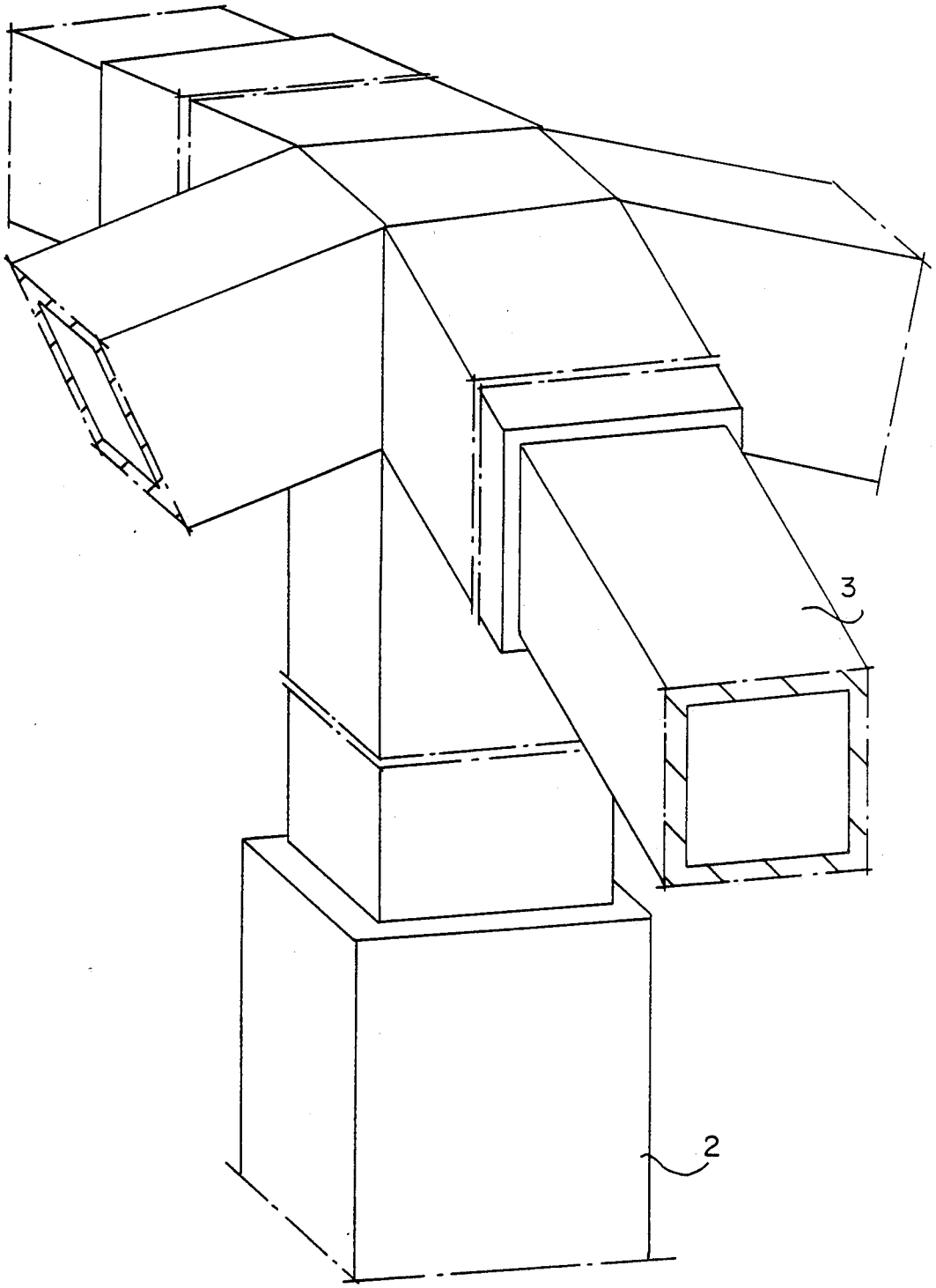
FIG. 4 shows a detail of FIG. 1.
Figure 5:
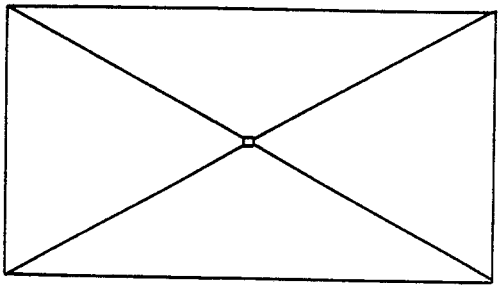
Figure 6:
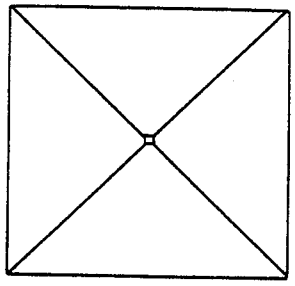
Figure 9:
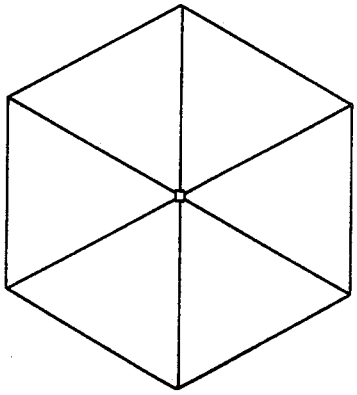
Figure 7:
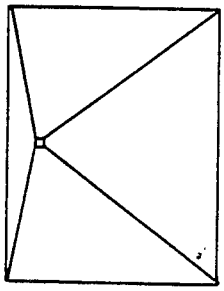
Figure 8:
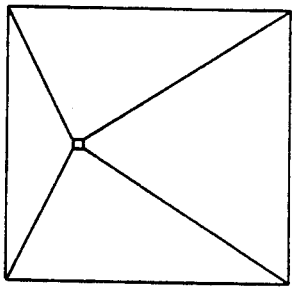
Figure 10:
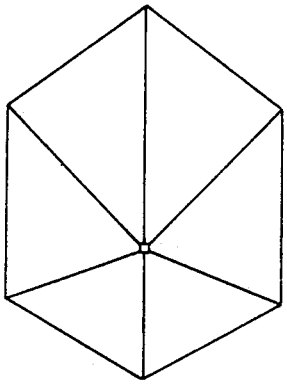

FIGS. 5 to 10 show examples of possible floor plan shapes, i.e. as seen from a point above the center of the roof skin, whereby FIG. 5 is a rectangle, FIG. 6 a square, FIGS. 7 and 8 are designs with roof locking bars of unequal lengths which cause the mast position in the outline to be shifted in direction of the shorter locking bars, FIG. 9 shows the outline of a symmetric polygon (hexagon) and FIG. 10 shows the outline of an assymetric polygon.

With reference to FIGS. 1 to 4, the following should be noted:

The traveling and supportable platform consists of the actual platform 1.1, of the wheels or rollers 1.2 as well as of the supports 1.3. In this case the supportable platform can be in form of a flatbed authorized for circulation on the road.

The telescoping support mast 2 with its base element 2.1 is mounted vertically at the center of gravity of the platform 1, with the sub-elements 2*n* being telescoped into the base element.

The cross-section of the mast is prismatic, and in the present example a square has been selected for the basic cross-section.

The base locking bars 3.1 of the telescoping locking bars are attached to the last sub-element 2*n*, i.e. to the end of supporting mast 2, in a predetermined direction and at a predetermined angle, and all sub-elements 3*n* of each base element are telescoped into the latter in transportation position, with each last sub-element 3*n* determining the tension of the roof skin 4 of the tent in its deployed state. The connection to the end of each element 3*n* is required during telescoping to achieve satisfactory, automatic folding.

The base element 2.1 of the supporting mast 2 is as a rule sized in function of the height of the platform 1.1 and of the projection, in telescoped position of the locking bars, beyond the base element 2.1 while practically utilizing the entire height permitted by traffic regulations.

The same applies to the base elements 3.1 of the locking bars 3 which are of such length, in a telescoped state, that they do not exceed the width permitted by regulations when 2 basic locking bar lengths are added together, their positions being taken into account.

As mentioned initially, the telescoping mast 2 and the locking bars can be deployed or telescoped as desired, by hydraulic or pneumatic and/or mechanical means.

In view of the variability of drives and of basic shapes, these means are not discussed here in further detail since they represent the present state of the art, even in combination with the object of the invention.

It should also be mentioned that when the locking bars 3 are deployed they can in some instances be secured additionally by supports 5 oriented in direction of the road level and that the tent can be closed off by a cover 4.1 stretched from support to support.

No drawings of these measures are shown here since they are generally known.

I claim:

1. A self-erecting tent, comprising a telescoping central mast comprising a plurality of prismatic sections nested in one another and including a topmost section, a plurality of support arms fastened to the topmost section of said telescoping central mast and radiating said section in a plurality of directions and at predetermined angles from adjacent arms, said supporting arms being prismatic in cross section, a plurality of telescoping, prismatic extension arms nested in said support arms and adjustable to different radial lengths, said supporting arms and extension arms being self-supporting, and a foldable roof skin attached to free ends of said extension arms so that said roof skin is automatically stretched taut and forms a tent covering when said extension arms are extended, and said roof skin is automatically folded when said extension arms are retracted.

2. The self-erecting tent as in claim 1, wherein said telescoping central mast is vertically mounted on a platform.

3. The self-erecting tent as in claim 2, wherein said platform is equipped with stabilizing supports, and with wheels for transport.

4. The self-erecting tent as in claim 1, wherein struts, extending downward to the ground, are attached to said free ends.

5. The self-erecting tent as in claim 4, wherein vertical wall skins are attached to adjacent said struts.

6. The self-erecting tent as in claim 1, wherein the planform of said tent can be changed by changing the number of said supporting arms and radial lengths of said extension arms.

7. The self-erecting tent as in claim 2, wherein said telescoping central mast is mounted off-center on said platform and said plurality of support arms are of unequal lengths and are confined within a predetermined angular sector whose vertex is at said central mast.

8. The self-erecting tent as in claim 1, wherein said support arms are rigidly fixed to said central mast.

9. The self-erecting tent as in claim 1, wherein said predetermined angles are suitable for joining a second self-erecting tent similar to said self-erecting tent.

* * * * *